US006817481B2

(12) United States Patent
Alexander

(10) Patent No.: US 6,817,481 B2
(45) Date of Patent: Nov. 16, 2004

(54) ACCESS OPENING CLOSURE DEVICE

(76) Inventor: Thomson Alexander, 69 Grey La., Levittown, NY (US) 11756

( * ) Notice: Subject to any disclaimer, the term of this patent is extended or adjusted under 35 U.S.C. 154(b) by 0 days.

(21) Appl. No.: 10/610,162

(22) Filed: Jun. 30, 2003

(65) Prior Publication Data

US 2004/0000552 A1 Jan. 1, 2004

Related U.S. Application Data

(63) Continuation of application No. 09/781,482, filed on Feb. 12, 2001, now Pat. No. 6,598,546.
(60) Provisional application No. 60/182,040, filed on Feb. 11, 2000.

(51) Int. Cl.[7] ..... B65D 51/00
(52) U.S. Cl. ..... 220/476; 220/524; 220/315; 109/67
(58) Field of Search ..... 220/524, 525, 220/521, 260, 315, 476; 109/67; 232/43.1, 44

(56) References Cited

U.S. PATENT DOCUMENTS

| | | | | |
|---|---|---|---|---|
| 85,647 A | | 1/1869 | Dolan | |
| 618,314 A | | 1/1899 | Albes | |
| 845,964 A | | 3/1907 | Mittendorf | |
| 914,528 A | | 3/1909 | Thinnes | |
| 952,173 A | | 3/1910 | Zitko | |
| 972,948 A | | 10/1910 | Urban | |
| 1,239,307 A | | 9/1917 | Schmid | |
| 1,840,561 A | | 1/1932 | Bre Miller | |
| 2,869,780 A | | 1/1959 | Jensen | |
| 3,110,438 A | | 11/1963 | Leckner | |
| 3,263,854 A | | 8/1966 | Powers | |
| 3,709,539 A | | 1/1973 | Sodenkamp, Jr. | |
| 4,133,996 A | * | 1/1979 | Fread | 219/729 |
| 4,154,103 A | * | 5/1979 | Fling | 73/315 |
| 4,190,004 A | | 2/1980 | Richardson | |
| 4,245,776 A | | 1/1981 | Miner | |
| 4,418,628 A | | 12/1983 | Cahill | |
| 4,517,901 A | | 5/1985 | Clark | |
| 4,571,901 A | | 2/1986 | Morris et al. | |
| 5,205,224 A | | 4/1993 | Durst | |
| 5,615,624 A | | 4/1997 | Terry et al. | |
| 5,799,589 A | | 9/1998 | Clark | |
| 5,802,991 A | | 9/1998 | Brown et al. | |
| 5,921,191 A | | 7/1999 | Gabel | |
| 5,944,205 A | * | 8/1999 | LaJoie et al. | 215/11.5 |
| 6,082,591 A | * | 7/2000 | Healey | 222/158 |
| 6,126,211 A | | 10/2000 | Dominquez | |
| 6,378,769 B1 | | 4/2002 | Wolgamot | |
| 6,427,879 B1 | * | 8/2002 | Caldwell | 222/465.1 |
| 6,607,110 B2 | * | 8/2003 | Nusbaum | 225/43 |

FOREIGN PATENT DOCUMENTS

GB 2 156 427 A 10/1985

* cited by examiner

*Primary Examiner*—Joseph Man-Fu Moy
(74) *Attorney, Agent, or Firm*—Carter, DeLuca, Farrell & Schmidt, LLP

(57) ABSTRACT

An access opening closure device is provided for enabling passage of food or medication into a confined space without providing direct access from within the confined space to outside of the confined space. The device includes a housing defining a receptacle, an access door and a cover. The cover and the access door are independently movable between open and closed positions to provide access to within the receptacle. An engagement member is provided adjacent the access door to selectively lock the access door at a plurality of different positions.

7 Claims, 5 Drawing Sheets

ACCESS OPENING CLOSURE DEVICE

This application is a continuation of U.S. application Ser. No. 09/781,482 filed Feb. 12, 2001 now U.S. Pat. No. 6,598,546 and U.S. Provisional Application Serial No. 60/182,040, filed Feb. 11, 2000, both of which are incorporated herein by reference in their entirety.

BACKGROUND

1. Technical Field

The present disclosure relates to an access opening closure device for allowing articles to pass through an otherwise impervious wall. More specifically, the present disclosure relates to an access opening closure device for use in prisons and hospital psychiatric wards which allows an article to be passed through a cell or hospital room door without exposing a guard or hospital attendant to possible injury or battery by the prisoner or patient.

2. Background of Related Art

Prison cell and hospital room doors for confining dangerous inmates or patients which are fitted with an access opening to allow passage of food or medication without the necessity of opening the locked door are well known. The access opening may also be used to handcuff an inmate before unlocking the door. Typically, the access opening is small in relation to the door and is covered by a portal which may be closed to close the access opening. One problem associated with the above-described access opening/portal arrangement is that once the portal is opened, the confined inmate or patient has direct access to the area outside the confined space. Due to the violent nature of some confined inmates and/or patients, prison guards and hospital attendants are exposed to possible danger from the confined inmate or patient when direct access is available.

Accordingly, what is needed is an access opening closure device of simple construction which can be used in association with existing doors having access openings and is operable to allow passage of articles through the access opening without allowing an inmate or patient direct access from the confined space to the area outside of the confined space.

SUMMARY

An access opening closure device is provided for use in prisons, hospital psychiatric wards and the like is disclosed. The closure device includes a housing defining a receptacle, an access door and a top cover. The top cover is preferably formed from a transparent material and is movably supported on the housing to open or close a top opening in the housing. The access door is preferably formed from stainless steel and is movably supported on the housing to open or close a rear opening in the housing. A bracket assembly is secured to the housing about the rear opening. The bracket assembly is adapted to secure the housing about an access opening in a door, e.g., a prison cell door. The device also includes three locks. A first lock is positioned to retain the top cover in a closed position. A second lock is positioned to retain the access door in its closed position and a third lock is positioned to retain the access door in its open position.

BRIEF DESCRIPTION OF THE DRAWINGS

Various preferred embodiments of the access opening closure device are described herein with reference to the drawings, wherein.

DETAILED DESCRIPTION OF PREFERRED EMBODIMENTS

Figure 1:
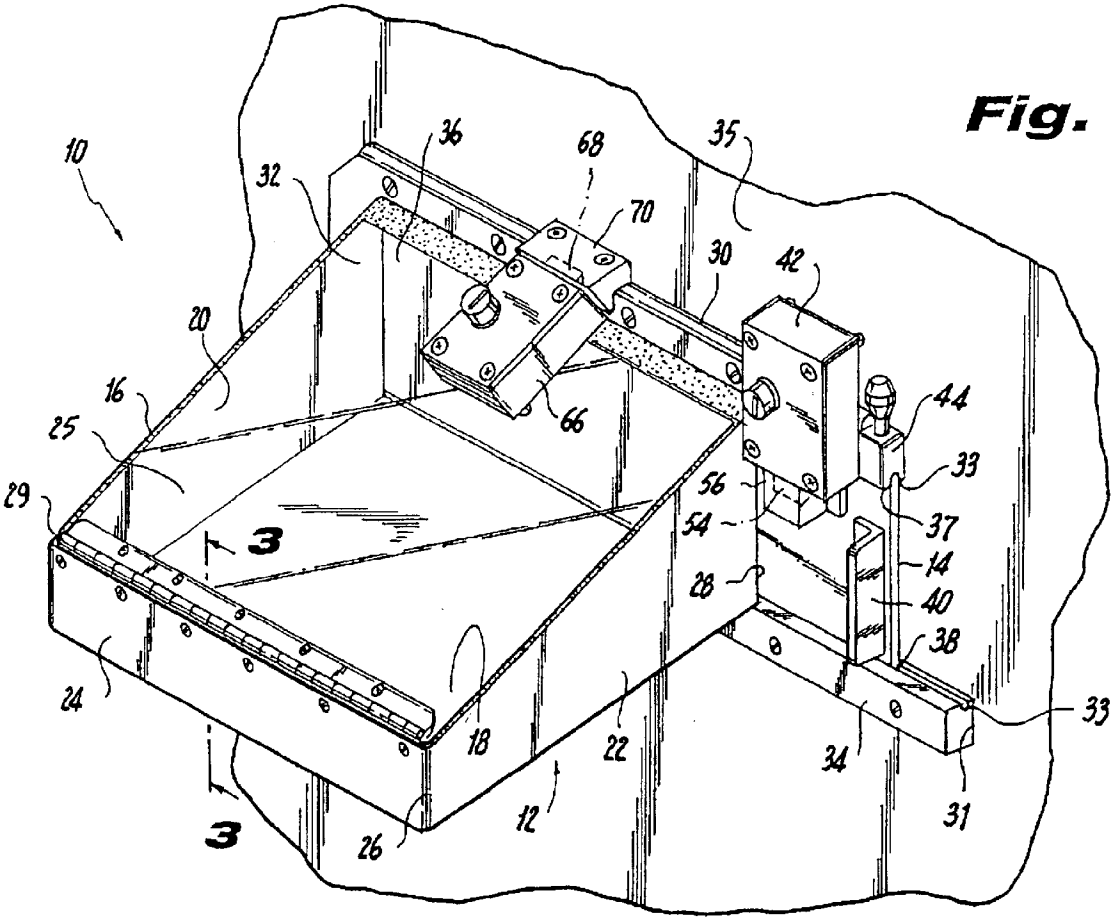
FIG. 1 is a perspective view of one embodiment of the presently disclosed access opening closure device.

Preferred embodiments of the presently disclosed access opening closure device will now be described in detail with reference to the drawings, in which like reference numerals designate identical or corresponding elements in each of the several views.

Figure 2:
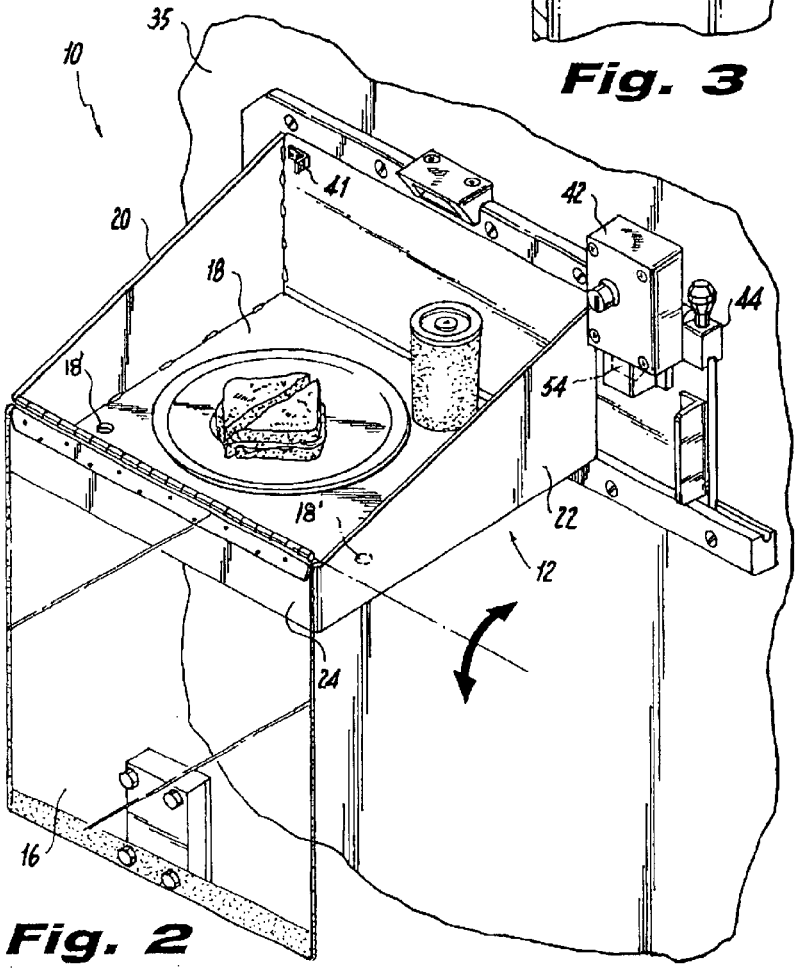
FIG. 2 is a perspective view of the access opening closure device shown in FIG. 1 with the top cover in its open position and its access door in its closed position.

FIGS. 1 and 2, illustrate an access opening closure device, shown generally as 10. Briefly, closure device 10 includes a housing 12, an access door 14 and a top cover 16. Housing 12 has a bottom wall 18, a pair of side walls 20 and 22 and a front wall 24 which defines a receptacle 25 for receiving food, medication or the like. A plurality of drain holes 18' (FIG. 2) are formed through the bottom wall 18 to allow fluid to drain therefrom. Side walls 20 and 22 have a height that increases from front end 26 to rear end 28 of housing 12. Alternately, the side walls can be rectangular. In extreme cases, when a prisoner or patient must be subdued before the guard enters the cell, the reduced height of front end 26 compared to rear end 28 of housing 12 enables the guard to spray a subduing agent, such as pepper spray or mace, directly into the cell. Preferably, housing 12 is constructed from stainless steel, although other materials having the requisite strength requirements can also be used.

Figure 3:
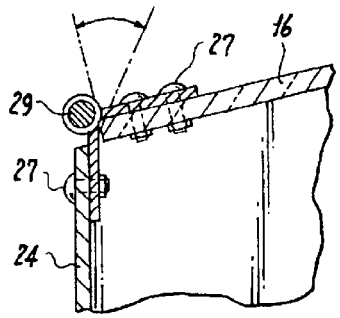
FIG. 3 is a partial cross-sectional view taken along section lines 3—3 of FIG. 1.

Referring also to FIG. 3, top cover 16 is pivotably attached to the top of front wall 24 via hinge assembly 29. Preferably, hinge assembly 29 is fastened to cover 16 and front wall 24 by screws 27. However, other fastening techniques may also be used including adhesives, welding, etc. Top cover 16 is pivotable from a first closed position enclosing housing 12 to a second open position uncovering housing 12. Preferably, cover 16 is constructed from a durable, transparent material such as Lexa® which permits viewing of the contents of receptacle 25 when top cover 16 is in the closed position. Alternately, other materials having the requisite strength requirements can also be used including stainless steel, aluminum or fire safe material having the requisite strength requirements.

A series of brackets including a top bracket 30, a side bracket 32 and a bottom bracket 34 are secured to the rear end of housing 12 by welding. Alternately, the series of brackets can be secured to housing 12 using other known fastening procedures. Each of the brackets includes a smooth concavity 33 for slidably receiving access door 14. The concavities formed in top and bottom brackets 30 and 34 define a guide track along which door 14 may be slid between open and closed positions. As illustrated in FIGS. 1 and 2, the guide track is formed in top and bottom brackets 30 and 32 at a position adjacent the back side 31 of the brackets which is to be positioned against the prison cell or hospital room door 35. By forming the guide track in this manner, access door 14 can be positioned close to door 35 while retaining the required thickness for strength. Side bracket 32 also includes a concavity (not shown) into which the forward end 36 of door 14 is positioned when door 14 is closed. Each of the brackets also includes a series of holes dimensioned to receive screws. The screws facilitate securement of the housing about an access port in door 35.

Access door 14 is slidably positioned along the guide track formed between top and bottom brackets 30 and 34. Door 14 includes a handle 40 to facilitate opening and closing of the door. Preferably, the top and bottom edges 37 and 38 of door 14 are radiused to permit door 14 to slide freely along the guide track. Door 14 is movable from a closed to an open position to permit access into housing 12 from within the confined space. A stop 41 (FIG. 2) is fastened to one side of access door 14. Stop 41 is positioned to engage side wall 22 when access door 14 is in the open position to prevent door 14 from sliding out of the guide track. Preferably, sliding door 14 is constructed from stainless steel. However, other materials having the requisite strength requirements may also be used.

Figure 4:
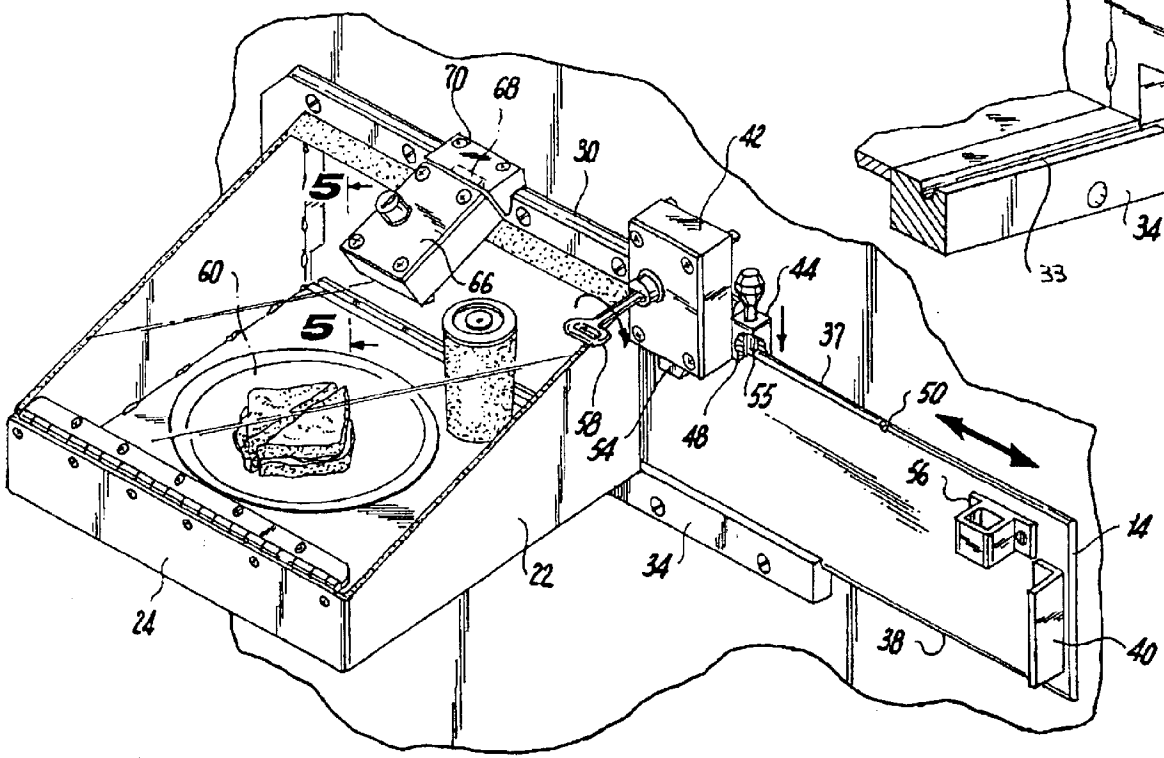
FIG. 4 is a perspective view of the access opening closure device shown in FIG. 1 with the top cover in a closed position and the access door in an open position.

A pair of locks 42 and 44 are secured adjacent to access door 14. Preferably, locks 42 and 44 are secured to top bracket 30 via screws. Alternately, locks 42 and 44 can be secured to door 35 and/or other fastening techniques may be used to secure the locks in place. Referring to FIG. 4, each lock includes a spring biased projection 54 and 55 which is urged downwardly towards the bottom frame. A catch 56 is secured to access door 14 and is positioned to engage projection 54 of lock 42. When projection 54 is positioned within catch 56, access door 14 is locked in a closed position. Projection 54 of lock 42 can be lifted from catch 56 by rotating key 58.

Lock 44 is positioned above top edge 37 of access door 14. A pair of recesses 48 and 50 formed in top edge 37 are positioned to receive projection 55 of lock 44. When projection 55 is biased into recess 48, access door 14 is locked in an open position. When projection 55 is biased into recess 50, access door 14 is locked in a half-open position. The combination of locks 42 and 44 prevents access door 14 from being slammed between its open and closed positions.

A lock 66 is also provided on top cover 16. Lock 66 includes a spring biased projection 68 which is receivable in a catch 70 to lock top cover 16 in the closed position. Catch 70 can be secured to top bracket 30. Alternately, catch 70 can be secured to other support structures, such as door 35.

In use, access opening closure device 10 is secured about an access opening in a door 35, e.g., a prison cell door. In the closed position, access door 14 and top cover 16 are closed (FIG. 1). When it is desired to provide the confined person with some item, such as a lunch tray 60, cover 16 is pivoted to open the top of housing 12. To pivot cover 16, lock 66 must be manually released. Lunch tray 60 is placed in receptacle 25 of housing 12 (FIG. 2). The access door 14 is closed. Next, sliding door 14 is slid open by manually rotating key 58 and pulling handle 40 (FIG. 4). It is noted that in order to slide access door 14 to the fully open position, projection 55 of lock 44 must be manually lifted over recess 50. The confined person now has access to the interior of housing 12 but the interior of housing 12 is enclosed with respect to the passageway in front of cell door 35. Thus, persons in the passageway are protected from any debris the confined person may attempt to throw through the access opening. With sliding door 14 in the open position and cover 16 in the closed position, the lunch tray or other item can be left in housing 12 for the confined person to retrieve at his or her convenience.

Access opening closure device 10 may also be used to handcuff a prisoner before releasing the prisoner from the cell. To handcuff a prisoner, access door 14 need only be opened to its halfway point with projection 55 of lock 44 positioned in recess 50 of door 14. After the prisoner places his hands through the access opening into receptacle 25, top cover 16 can be pivoted open to facilitate the placing of the handcuffs on the prisoner. It is noted that, with top cover 16 pivoted in front of a prison guard, top cover 16 acts as a shield for the guard.

Figure 5:
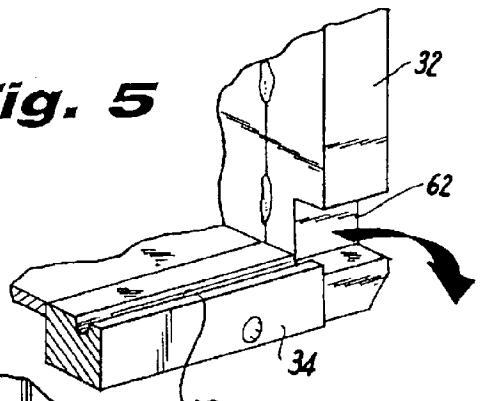
FIG. 5 is a partial cutaway view taken along section lines 5—5 of FIG. 4.

Referring to FIG. 5, a slot 62 is formed in side bracket 32 adjacent the concavity formed in bottom bracket 34. Slot 62 allows any debris positioned on the guide track in concavity 33, when access door 14 is opened, to be pushed from the end of the guide track. Thus, access door 14 will not be prevented from closing by placing debris on the guide track.

Figure 6:
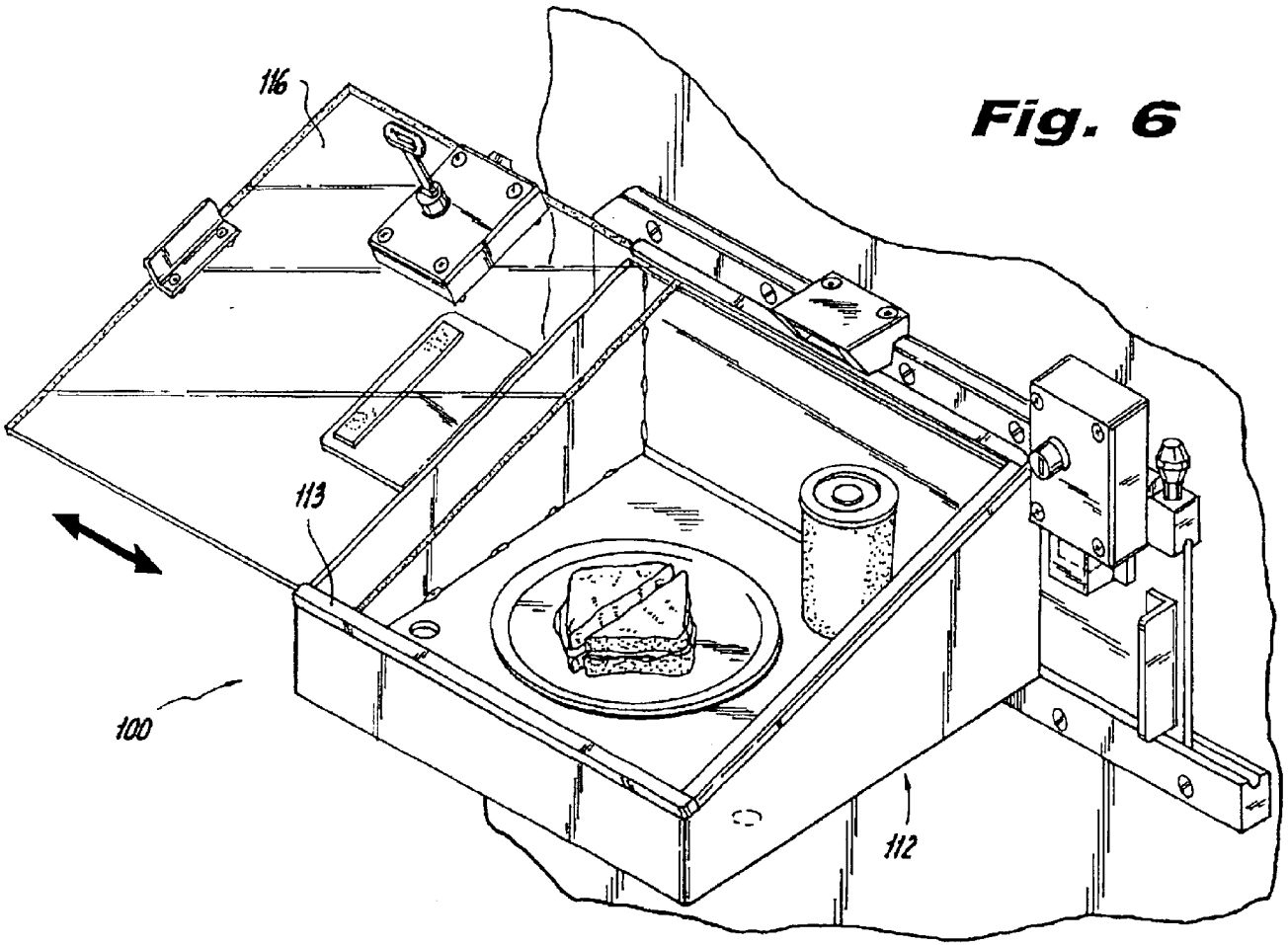
FIG. 6 is a perspective view of another embodiment of the present disclosed access opening closure device.

FIG. 6 illustrates an alternate embodiment of the access opening closure device shown generally at 100. Closure device 100 is substantially identical to closure device 10 except that top cover 115 is slidable between open and closed positions along a track 113 formed about the top of housing 112.

Figure 7:
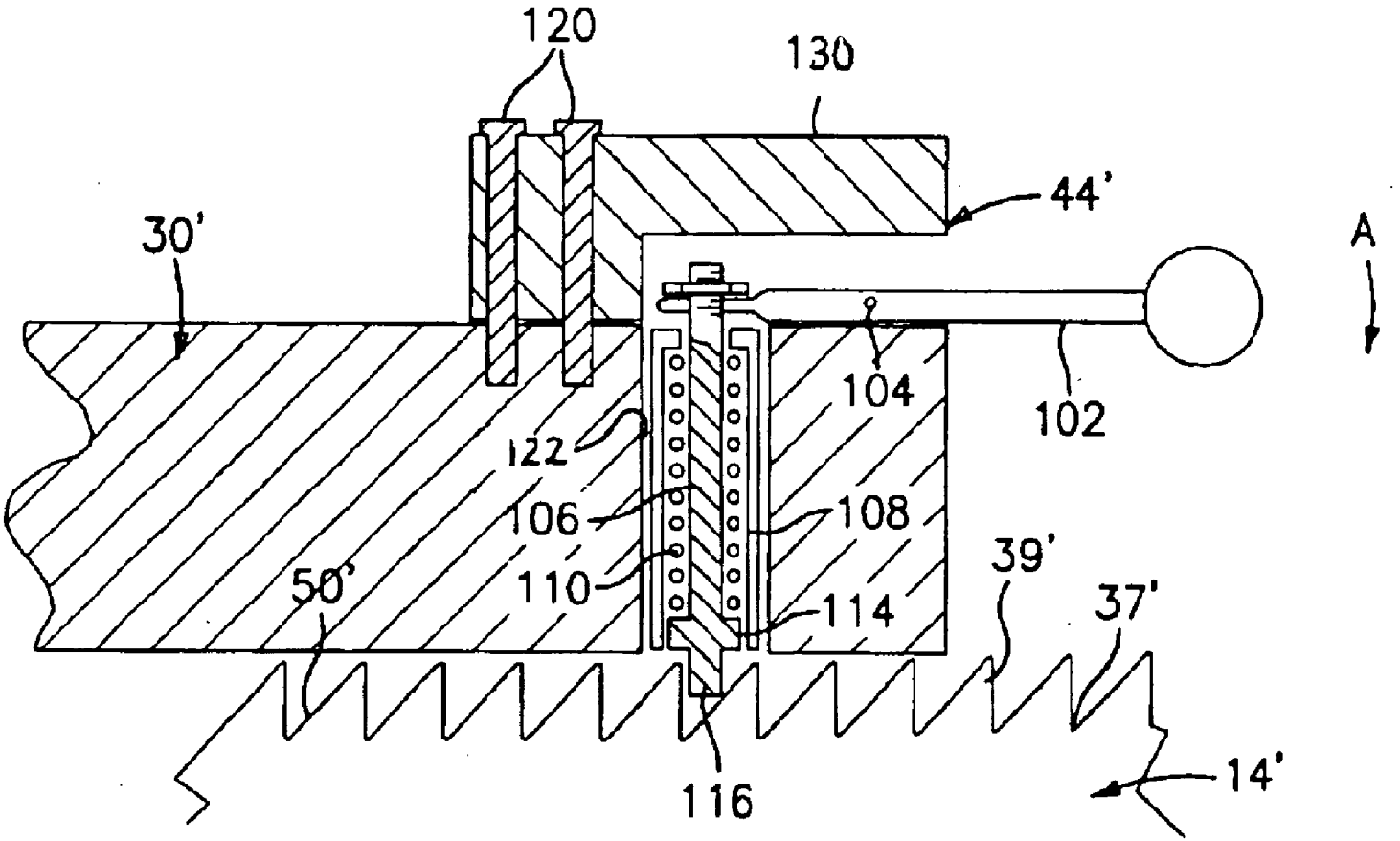
FIG. 7 illustrates a partial cutaway, cross-sectional view of an alternate embodiment of access door 14 and lock 44.

FIG. 7 illustrates a partial cutaway, cross-sectional view of an alternate embodiment of access door 14 and lock 44. In the alternate embodiment, access door 14' has a top edge 37' having a plurality of teeth 39'. Adjacent teeth define recesses 50'. Lock 44' includes a housing 130, a lever 102 pivotably by secured to housing 130 by a pivot pin 104, a reciprocal engagement member 106, a tubular inner housing 108 and a biasing member 110. Tubular inner housing 108 is threadably received within a threaded bore 122 formed in top bracket 30'. Engagement member 106 includes an annular flange 114 and a tooth engaging distal end 116. Biasing member 110 is positioned between flange 114 and the upper end of inner housing 108 and functions to urge distal end 116 of engagement member 106 into engagement with teeth 39' of access door 14'. Lever 102 is manually pivotable in the direction indicated by arrow "A" in FIG. 7 to lift engagement member 106 from engagement with access door 14'. Each tooth 39' includes a vertical surface 132 and a sloped surface 134. Engagement between vertical surface 132 and distal end 116 of member 106 prevents movement of access door 14' in the direction indicated by arrow "B" n FIG. 7. Engagement between sloped surface 134 and distal end 116 of member 106 urges member 106 upwardly against the bias of biasing member 110 to permit movement of access door 14' in the direction indicated by arrow "C" in FIG. 7. Teeth 39' and lock 44' prevent access door 14' from being repeatedly slammed between open and closed positions. Housing 130 of lock 44' can be secured to top bracket 30' using screws 120. Alternately, other attachment devices may be used to secure housing 130 to bracket 30', e.g., brazing, welding, etc.

It will be understood that various modifications may be made to the embodiments disclosed herein. For example, access door 14 need not slide horizontally but rather may slide vertically. Further, the dimensions of the access opening closure device can be varied to accommodate any size access opening. Moreover, the access opening closure device is not limited for use on hospital room and prison cell doors but rather may be used in other areas such as bank teller stations. Therefore, the above description should not be construed as limiting, but merely as exemplifications of preferred embodiments. Those skilled in the art will envision other modifications within the scope and spirit of the claims appended hereto.

What is claimed is:

1. An access opening closure device configured to be positioned about an opening on a secure side of a support structure, the access opening closure device comprising:

a housing having an outer portion and an inner portion, said inner portion defining a fixed receptacle;

a first door movably supported on the housing, the first door being movable from a first position at least partially covering a first opening of the receptacle to a second position at least partially uncovering the first opening of the receptacle;

a second door movably supported on the housing, the second door being movable from a first position at least partially covering a second opening of the receptacle to a second position at least partially uncovering the second opening of the receptacle;

at least one lock operable to retain the second door in its first position and in its second position; and wherein the first door and the second door are positioned to be primarily operable only from a secure side of a support structure on which the access opening closure device is positioned.

2. An access opening closure device configured to be positioned about an opening on a secure side of a support structure, the access opening closure device comprising:

a housing having an outer portion and an inner portion, said inner portion defining a fixed receptacle having a rear opening;

a first door movably supported on the housing, the first door being movable from a first position at least partially covering a first opening of the receptacle to a second position at least partially uncovering the first opening of the receptacle;

a second door movably supported on the housing, the second door being movable from a first position at least partially covering the second opening of the receptacle to a second position at least partial uncovering the second opening of the receptacle; and a bracket assembly secured to the housing, the bracket assembly being mounted adjacent the second opening of the housing to secure the access closure device to a support structure;

wherein the first door and the second door are positioned to be primarily operable only from the secure side of a support structure on which the access opening closure device is positioned.

3. An access opening closure device according to claim 2, wherein the bracket assembly includes a top, a bottom and a side bracket, each of the brackets being positioned about the second opening of the housing.

4. An access opening closure device according to claim 2, further including a first lock the first lock being operable to retain the second door in its first position.

5. An access opening closure device according to claim 4, further including a second lock, the second lock being operable to retain the first door in its first position.

6. An access opening closure device according to claim 2, wherein the housing is constructed from stainless steel.

7. An access opening closure device according to claim 2, wherein the first door is constructed from a transparent material.

* * * * *

UNITED STATES PATENT AND TRADEMARK OFFICE

CERTIFICATE OF CORRECTION

PATENT NO. : 6,817,481 B2
APPLICATION NO. : 10/610162
DATED : November 16, 2004
INVENTOR(S) : Thomson Alexander It is certified that error appears in the above-identified patent and that said Letters Patent is hereby corrected as shown below:

Title page, item [63] should read as follows:

-- This application is a continuation of U.S. Application Serial No. 09/781,482, filed February 12, 2001, now U.S. Patent No. 6,598,546 which claims priority from U.S. Provisional Application Serial No. 60/182,040, filed February 11, 2000 which is incorporated in its entirety herein by reference, and is a continuation-in-part of U.S. Application Serial No. 09/369,366, now U.S. Patent No. 6,302,325 which was filed on August 6, 1999 and claims priority from U.S. Provisional Application Serial No. 60/141,171 filed on June 25, 1999. --

Signed and Sealed this
Twelfth Day of June, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 6,817,481 B2
APPLICATION NO. : 10/610162
DATED : November 16, 2004
INVENTOR(S) : Thomson Alexander It is certified that error appears in the above-identified patent and that said Letters Patent is hereby corrected as shown below:

This certificate supersedes the Certificate of Correction issued June 12, 2012. The certificate is vacated since Petition to accept unintentionally delayed claim of priority under 37 C.F.R. 1.78(a)(2) was not granted by the Office of Petitions. The Certificate of Correction was published in error and should not have been issued for this patent.

Signed and Sealed this
Fourteenth Day of August, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 6,817,481 B2
APPLICATION NO. : 10/610162
DATED : November 16, 2004
INVENTOR(S) : Thomson Alexander It is certified that error appears in the above-identified patent and that said Letters Patent is hereby corrected as shown below:

In the Specification

Column 1, lines 2-7, please amend the priority claim of this application to read as follows:

-- This application is a continuation of U.S. Application Serial No. 09/781,482, filed February 12, 2001, now U.S. Patent No. 6,598,546 which claims priority from U.S. Provisional Application Serial No. 60/182,040, filed February 11, 2000 which is incorporated in its entirety herein by reference, and is a continuation-in-part of U.S. Application Serial No. 09/369,366, now U.S. Patent No. 6,302,325 which was filed on August 6, 1999. --

Signed and Sealed this
Fourteenth Day of January, 2014

Michelle K. Lee

Michelle K. Lee
*Deputy Director of the United States Patent and Trademark Office*